United States Patent [19]

Boyle

[11] 3,942,788

[45] Mar. 9, 1976

[54] SHEET MATERIAL TRANSPORT EQUIPMENT

[75] Inventor: Robert A. Boyle, Mission Viejo, Calif.

[73] Assignee: Bell & Howell Company, Chicago, Ill.

[22] Filed: June 13, 1974

[21] Appl. No.: 479,008

[52] U.S. Cl. ..... 271/250; 198/213; 226/95; 226/168; 271/196; 271/276

[51] Int. Cl.[2] ..... B65H 9/04; B65H 5/22

[58] Field of Search ..... 271/248, 250, 251, 264, 271/276, 196, 194, 225, 63, 8, 80, 94, 96; 198/213; 226/95, 168

[56] References Cited

UNITED STATES PATENTS

| | | | |
|---|---|---|---|
| 849,122 | 4/1907 | George | 198/213 X |
| 1,564,926 | 12/1925 | Armstrong et al. | 198/213 |
| 3,411,772 | 11/1968 | Rovin | 271/264 X |
| 3,412,915 | 11/1968 | Hertrich | 271/194 X |
| 3,424,452 | 1/1969 | Jones | 271/100 |

*Primary Examiner*—Evon C. Blunk
*Assistant Examiner*—Bruce H. Stoner, Jr.
*Attorney, Agent, or Firm*—Benoit Law Corporation

[57] ABSTRACT

An apparatus for advancing a sheet of material comprises a rotary member having a longitudinal axis about which it is rotated and having projecting helical propelling ridges. Equipment is provided for biasing the sheet of material to be transported towards the rotary member by drawing air through apertures at the projecting ridges. The rotary member advances the sheet of material essentially in parallel to the longitudinal axis.

8 Claims, 3 Drawing Figures

SHEET MATERIAL TRANSPORT EQUIPMENT

BACKGROUND OF THE INVENTION

1. Field of the Invention

The subject invention relates to material transport equipment and, more specifically, to apparatus for advancing cards or sheets of paper or other material.

2. Description of the Prior Art

The need for apparatus for advancing sheets of material is well known and recognized and touches upon the fields of manufacture and processing as well as on areas of the data handling and processing art.

Most commonly available equipment for transporting sheets of material employ rollers or belts to achieve the the requisite translation of the sheets. Such equipment requires precise alignment of the various parts of the driving or transporting system to insure that the paper proceeds on the desired path without skew and in the proper laterally referenced position.

The basic problem of such transporting equipment is the inability to provide "slip" in an orthogonal direction (in the plane of the sheet) to the desired direction of travel.

A further problem is the difficulty of existing equipment to hold the sheet within the desired limits describing a plane, without adding friction sufficient to cause buckling or tearing, and without encumbering operations, such as sensing or marking, associated with the transport of the sheet.

How little existing proposals in other areas are adaptable to a solution of the above mentioned problems may be seen from the following issued patents:

U.S. Pat. Nos. 2,811,920, by J. T. Richardson, issued Nov. 5, 1957, 3,389,907, by L. H. Turner, issued June 25, 1968, 3,411,772, by H. Rovin, issued Nov. 19, 1968, 3,618,935, by George F. Howatt, issued Nov. 9, 1971, and 3,715,115, by W. Grobman, issued Feb. 6, 1973.

SUMMARY OF THE INVENTION

It is a broad object of this invention to overcome the above mentioned disadvantages.

It is a related object of the invention to provide the improved apparatus and techniques for advancing sheets of material in a continuous or continual manner.

It is also an object of the invention to provide improved sheet advancing apparatus which impart a vector force to the sheet and allow a controlled amount of slip in both the direction of travel and orthogonally to that direction.

From another aspect thereof, the invention resides in apparatus for advancing a sheet of material comprising, in combination, a rotary member having a longitudinal axis, means including projecting propelling means on the rotary member for advancing said sheet in a direction extending essentially in parallel to said longitudinal axis, means for applying the sheet to the projecting propelling means, and means for rotating the rotary member whereby to advance the applied sheet, said rotary member having apertures at said projecting propelling means, and said applying means including means for drawing air through said apertures whereby said sheet is drawn against said propelling means.

From a further aspect thereof, the invention resides in an apparatus for advancing a sheet of material, comprising in combination a rotary member having a longitudinal axis, means for rotating the rotary member about said longitudinal axis, means for biasing said sheet toward the rotary member, and means on said rotary member for advancing said sheet essentially in parallel to said longituidnal axis, said advancing means including screw-type propelling means on said rotary member, said rotary member having apertures at said screw-type propelling means, and said biasing means including means for drawing air through said apertures whereby said sheet is drawn against said propelling means.

From a further aspect thereof, the invention resides in an apparatus for advancing a sheet of material, comprising in combination a rotary member having a longitudinal axis, means for rotating the rotary member about said longitudinal axis, means adjacent said rotary member for guiding said advancing sheet, means for biasing said sheet toward the rotary member, and means on said rotary member for advancing said sheet essentially in parallel to said longitudinal axis, said advancing means including screw-type propelling means on said rotary member, said rotary member having apertures at said screw-type propelling means, and said biasing means including means for drawing air through said apertures whereby said sheet is drawn against said propelling means.

From a further aspect thereof, the invention resides in an apparatus for advancing a sheet of material, comprising in combination a rotary member having a longitudinal axis, means including projecting propelling means on said rotary member for advancing said sheet in a direction extending essentially in parallel to said longitudinal axis, means for applying said sheet to said projecting propelling means, and means for rotating said rotary member whereby to advance said applied sheet, said propelling means including projecting screw-type propelling means on said rotary member, said rotary member having apertures at said screw-type propelling means, and said applying means including means for drawing air through said apertures whereby said sheet is drawn against said screw-type propelling means.

From a further aspect thereof, the invention resides in an apparatus for advancing a sheet of material, comprising in combination a rotary member having a longitudinal axis, means including projecting propelling means on said rotary member for advancing said sheet in a direction extending essentially in parallel to said longitudinal axis, means for applying said sheet to said projecting propelling means, and means for rotating said rotary member whereby to advance said applied sheet, said applying means including means for defining a laterally confined channel in parallel to a longitudinal axis of said rotary member, and means for drawing a vacuum through said channel, said rotary member being hollow-cylindrical and encompassing said channel-defining means, and defining apertures for drawing said sheet with said vacuum to said projecting propelling means, and said apparatus including means for maintaining said channel-defining means relatively stationary.

BRIEF DESCRIPTION OF THE DRAWINGS

The invention will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
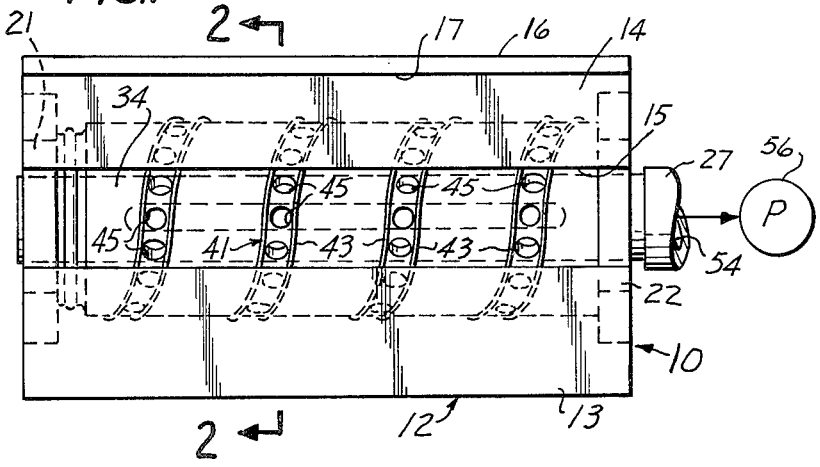
FIG. 1 is a top view of a sheet advancing apparatus in accordance with a preferred embodiment of the subject invention.

The sheet advancing apparatus 10 shown in the drawings comprises a table 12 having leaves 13 and 14 defining a longitudinal slot 15 therebetween. An upright portion 16 integral with the table leaf 14 defines a guiding edge 17 for the advancing sheet of material 18. The table 12 may be mounted on other structure (not shown) in any suitable conventional manner.

Figure 2:
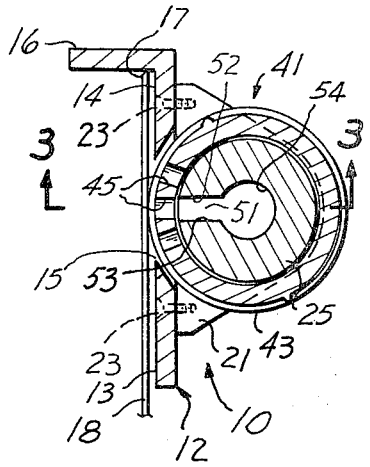
FIG. 2 is a section taken along the line 2 — 2 in FIG. 1.
Figure 3:
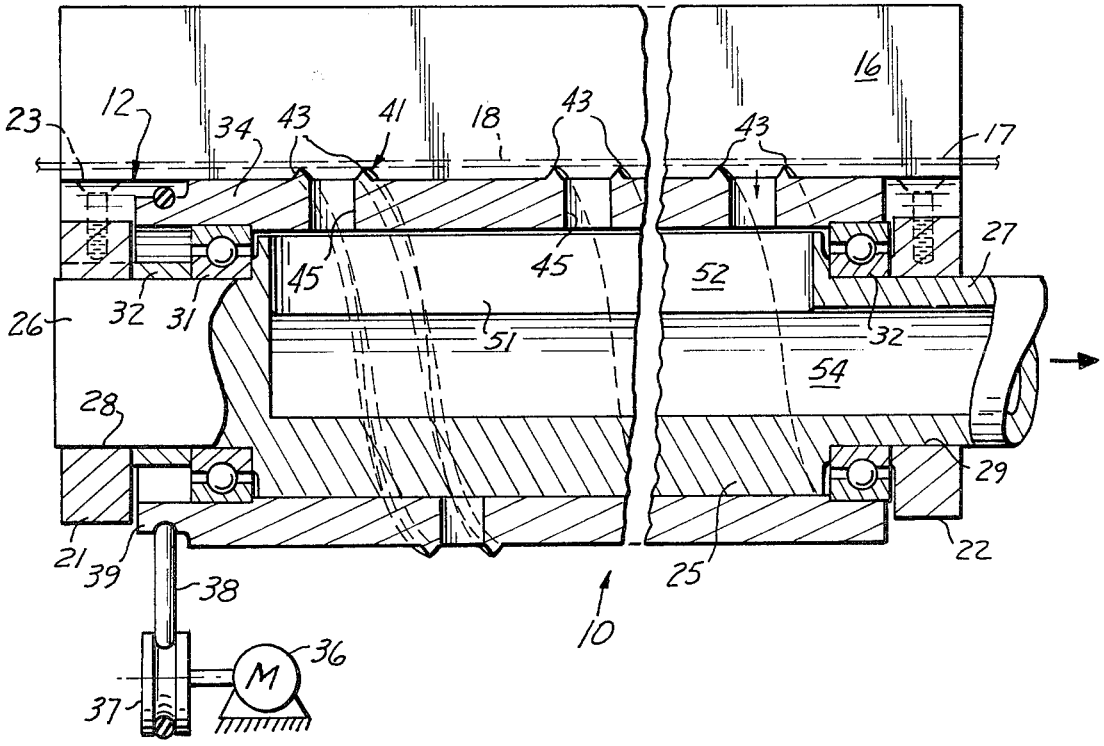
FIG. 3 is a fore-shortened section, on an enlarged scale, taken along the line 3 — 3 in FIG. 2.

Two mounting blocks 21 and 22 are attached to the table 12 at opposite ends thereof by suitable fasteners, such as screws, three of which are seen in FIGS. 2 and 3 at 23. If desired, the blocks 21 and 22 may be employed for structurally supporting and spacing the table leaf 13 relative to the table leaf 14.

A core structure 25 has shaft portions 26 and 27 fitted into corresponding apertures 28 and 29 in the blocks 21 and 22. The core structure is held stationary in the blocks 21 and 22, either by means of a press fit or with the aid of fasteners (not shown). In other words, the core structure 25 does not rotate relative to the table 12.

The shaft portion 26 of the core structure 25 carries a roller bearing 31 and a spacer ring between the block 21 and the bearing 31. The shaft portion 27, on the other hand, carries a roller bearing 32.

A hollow-cylindrical rotatable member or rotor 34 encompasses the core structure 25 and is located on the outer races of the ball bearings 31 and 32. These ball bearings thus mount the rotor 34 for rotation about the core structure 25 and relative to the table 12. The rotor 34 is driven by a motor 36 via a motor output pulley 37, an elastomeric transmission belt 38 and a pulley structure 39 integral with the rotor 34.

Projecting propelling devices 41 are located on the rotor 34. In accordance with a preferred embodiment of the subject invention, these propelling devices are preferably of a helical nature. In the illustrated preferred embodiment, ridges in the form of a double helix 43 are provided on the rotor 34.

The rotor 34 has a series of apertures 45 between adjacent portions of the helices 43. In the illustrated preferred embodiment, these apertures 45 are arranged in a regular helical pattern reaching from adjacent one end to adjacent the other end of the rotor 34 about its axis of rotation.

As best seen in FIG. 1, successive portions of the rotor 34 are exposed at the slot 15 between the table leaves 13 and 14 when the motor 36 rotates the rotor about its longitudinal axis. In this manner, successive openings 45 and adjacent portions of the helical propelling devices 41 are exposed at the table opening or slot 15. These successively exposed openings are in their turn placed into communication with a channel 51 defined by the core structure 25 in parallel to the longitudinal axis of the rotor 34. As best seen in FIG. 2, the longitudinal channel 51 is laterally confined by internal wall portions 52 and 53 of the core structure 25. In the illustrated preferred embodiment, the longitudinal channel 51 in the core structure 25 is thus narrower than the width of the table slot 15.

The channel 52 is in communication with a longitudinal bore 54 in the core structure 25. As indicated in FIG. 1, the longitudinal bore 54 of the core structure 25 is connected to a vacuum pump 56 or other exhausting device.

The pump 56 draws a vacuum through openings 45, channel 51 and bore 54 in a conventional manner. Because of the laterally confined nature of the channel 51, the vacuum is drawn through only those openings 45 which, at the time, are located midway between the table leaves 13 and 14 within the slot 15. The gas or air pressure gradient provided by the evacuation process is thus sharply confined to the area of the sheet 18 at which the provision of a force vector acting radially toward the center of rotation of the rotor 34 is desired. This force vector or series of force vectors along the sheet 18 bias the sheet toward the rotor 34 and thereby apply the sheet to the helical or screw-type propelling devices 41 and 43. The rotating helical propelling devices, in turn, impart to the sheet 18 a force vector which is axially oriented relative to the rotor 34. Accordingly, the sheet 18 is propelled along the table 12.

In the illustrated preferred embodiment, a straight edge 17 essentially in parallel to the longitudinal axis of the rotor 34 is provided for guiding the continuously moving sheet 18 along the table 12. Skew and other misalignments are automatically corrected or avoided by the apparatus of the subject invention which imparts a vector force to the sheet 18 and allows a controlled amount of slip in both the direction of travel and orthogonally to that direction.

Accordingly, a highly precise operation with relatively simple and rugged equipment is readily accomplished, rendering the subject invention not only suitable for manufacturing and material processing purposes, but also in the delicate areas of data handling and processing, to name but two examples.

The subject extensive disclosure will suggest or render apparent various modifications and variations within the spirit and scope of the subject invention.

I claim:

1. An apparatus for advancing a sheet of material, comprising in combination:

a rotary member having a longitudinal axis;

means for rotating the rotary member about said longitudinal axis;

means for biasing said sheet toward the rotary member; and means on said rotary member for advancing said sheet essentially in parallel to said longitudinal axis;

said advancing means including screwtype propelling means on said rotary member;

said rotary member having apertures at said screwtype propelling means; and said biasing means include means for drawing air through said apertures whereby said sheet is drawn against said propelling means.

2. An apparatus for advancing a sheet of material, comprising in combination:

a rotary member having a longitudinal axis;

means for rotating the rotary member about said longitudinal axis;

means adjacent said rotary member for guiding said advancing sheet;

means for biasing said sheet toward the rotary member; and means on said rotary member for advancing said sheet essentially in parallel to said longitudinal axis;

said advancing means including screw-type propelling means on said rotary member;

said rotary member having apertures at said screw-type propelling means; and said biasing means including means for drawing air through said apertures whereby said sheet is drawn against said propelling means.

3. An apparatus for advancing a sheet of material comprising in combination:

a rotary member having a longitudinal axis;

means including projecting propelling means on said rotary member for advancing said sheet in a direction extending essentially in parallel to said longitudinal axis;

means for applying said sheet to said projecting propelling means; and means for rotating said rotary member whereby to advance said applied sheet;

said rotary member having apertures at said projecting propelling means; and said applying means including means for drawing air through said apertures whereby said sheet is drawn against said propelling means.

4. An apparatus for advancing a sheet of material, comprising in combination:

a rotary member having a longitudinal axis;

means including projecting propelling means on said rotary member for advancing said sheet in a direction extending essentially in parallel to said longitudinal axis;

means for applying said sheet to said projecting propelling means; and means for rotating said rotary member whereby to advance said applied sheet;

said propelling means including projecting screw-type propelling means on said rotary member;

said rotary member having apertures at said screw-type propelling means; and said applying means including means for drawing air through said apertures whereby said sheet is drawn against said screw-type propelling means.

5. An apparatus as claimed in claim 4, including:

means adjacent said rotary member for guiding said advancing sheet.

6. An apparatus as claimed in claim 5, wherein:

said sheet guiding means define a straight edge essentially parallel to the axis of rotation of said rotary member.

7. An apparatus for advancing a sheet of material, comprising in combination:

a rotary member having a longitudinal axis;

means including projecting propelling means on said rotary member for advancing said sheet in a direction extending essentially in parallel to said longitudinal axis;

means for applying said sheet to said projecting propelling means; and means for rotating said rotary member whereby to advance said applied sheet;

said applying means including means for defining a laterally confined channel in parallel to a longitudinal axis of said rotary member, and means for drawing a vacuum through said channel;

said rotary member being hollow-cylindrical and encompassing said channel-defining means, and defining apertures for drawing said sheet with said vacuum to said projecting propelling means; and said apparatus including means for maintaining said channel-defining means relatively stationary.

8. An apparatus as claimed in claim 2, wherein:

said sheet guiding means define a straight edge essentially in parallel to said longitudinal axis.

* * * * *